US006052825A

United States Patent [19]

Dodd

[11] Patent Number: 6,052,825

[45] Date of Patent: Apr. 25, 2000

[54] WATERTIGHT CAP WITH ADHESIVE SEAL

[76] Inventor: Karetha Dodd, 555 W. Madison #2003, Chicago, Ill. 60661

[21] Appl. No.: 09/245,114

[22] Filed: Jan. 25, 1999

[51] Int. Cl.[7] ..... A42B 1/12

[52] U.S. Cl. ..... 2/68; 2/181; 2/181.8

[58] Field of Search ..... 2/68, 181, 181.8, 2/200.2

[56] References Cited

U.S. PATENT DOCUMENTS

| | | | |
|---|---|---|---|
| 2,730,720 | 1/1956 | Saunders | 2/68 |
| 3,793,110 | 2/1974 | Saunders | 2/68 |
| 3,852,823 | 12/1974 | Jones | 2/68 |

*Primary Examiner*—Diana Oleksa
*Attorney, Agent, or Firm*—Larry L. Saret; Rita A. Abbati; Laff, Whitesel & Saret, Ltd.

[57] ABSTRACT

This invention relates to a watertight cap with a sealing structure comprised of an adhesive strip, which adhesive strip is used to temporarily seal the margin of the cap to the wearer's head. The cap also contains a circumferential foldable crease (or fold-line) located behind the adhesive strip which allows the wearer to fold back the adhesive strip until the cap is properly positioned on the wearer's head. The cap further contains a circumferential border located immediately behind or in front of the foldable crease (or fold-line) which border prevents the adhesive strip from contacting the wearer's hair.

4 Claims, 1 Drawing Sheet

WATERTIGHT CAP WITH ADHESIVE SEAL

CROSS REFERENCE TO RELATED APPLICATIONS

Not Applicable

STATEMENT REGARDING FEDERALLY SPONSORED RESEARCH OR DEVELOPMENT

Not Applicable

REFERENECE TO MICROFICHE APPENDIX

Not Applicable

BACKGROUND OF INVENTION

1. Field of Invention

This invention relates to caps worn by persons (a) partially or fully submerged in water or other liquid or substance or (b) otherwise exposed to water or other liquid or substance (including, without limitation, persons engaged in aquatic activities such as swimming and diving), and who desire that such water or other liquid or substance not contact their hair or ears, as exemplified by swimming caps, shower caps and bathing caps. This invention relates to the foregoing as well as being lightweight, comfortable (i.e. an uncomfortably tight fit is not necessary to maintain a watertight seal) and as simple to put on as traditional caps, all the while retaining the external appearance of traditional caps. Various cap circumference and cap margin sizes are contemplated by this application.

2. Description of Prior Arts

Prior comparable caps which have offered a watertight seal (a) are not entirely watertight, and/or (b) require a complicated series of steps be performed by the wearer of the cap in order to obtain a watertight seal, and/or (c) necessitate that the wearer wear a cumbersome apparatus in order to obtain a watertight seal, and/or (d) compromise many of the advantages of tradition caps, including, without limitation, aerodynamic design, virtual weightlessness and simplicity of design, and/or (e) look notably different than traditional caps making the cap less desirable for many wearers, and/or (f) fit so tightly on the wearer's head that the tension of the cap is uncomfortable.

U.S. Pat. Nos. 5,349,702 and 4,281,417 have been issued for "leakproof" and/or "watertight" swimming caps, but the foregoing are not related to the present invention, and do not contain the features which make this invention new. U.S. Pat. No. 5,349,702 achieves its watertight seal through a cushion structure and an inflatable bladder structure disposed between the cap and the cushion structure. U.S. Pat. No. 4,281,417 also achieves its watertight seal through a structure which includes an inflatable band. Other patents concerning swimming caps are either not watertight or are helmets (i.e. made of non-flexible material).

BRIEF SUMMARY OF THE INVENTION

This invention provides a watertight, comfortable (i.e. no excessive squeezing of the wearer's head), simple-to-use, externally traditional looking swimming and/or showering and/or bathing cap which features a sealing structure along the inside margin of the cap composed of a waterproof adhesive strip which may be shaped to track the curvatures of the wearer's head and neck, and which adhesive strip is used to temporarily seal the cap to the wearer's head preventing water or other liquid or substance from entering the cap.

The objects and advantages of this invention are to provide a watertight cap which is lightweight, comfortable, as simple to put on as a hat and retains the external appearance and functional advantages of traditional versions of such caps. Still further objects and advantages will become apparent from a consideration of the ensuing descriptions and drawings.

In the preferred embodiment, the invention comprises a swimming cap manufactured of a waterproof, lightweight, flexible, resilient material such as rubber, latex, silicone or the like, featuring a margin, extending across the wearer's forehead and temples, under the wearer's ears and along the back of the wearer's neck, which margin is internally lined with a waterproof adhesive strip which temporarily seals the cap's margin to the wearer's head. The swimming cap also features a foldable circumferential crease (or fold-line) located directly behind the adhesive strip. This foldable crease (or fold-line) allows the wearer to fold back the adhesive-covered portion of the cap while the cap is being properly positioned on the wearer's head. The swimming cap also features a circumferential border made of the same material as the shell of the cap, which border is located immediately behind the afore-described foldable crease (or fold-line). The purpose of the border is to prevent the adhesive strip from contacting the wearer's hair. The locations of the crease (or fold-line) and border are interchangeable.

DETAILED DESCRIPTION OF THE INVENTION

Figure 1:
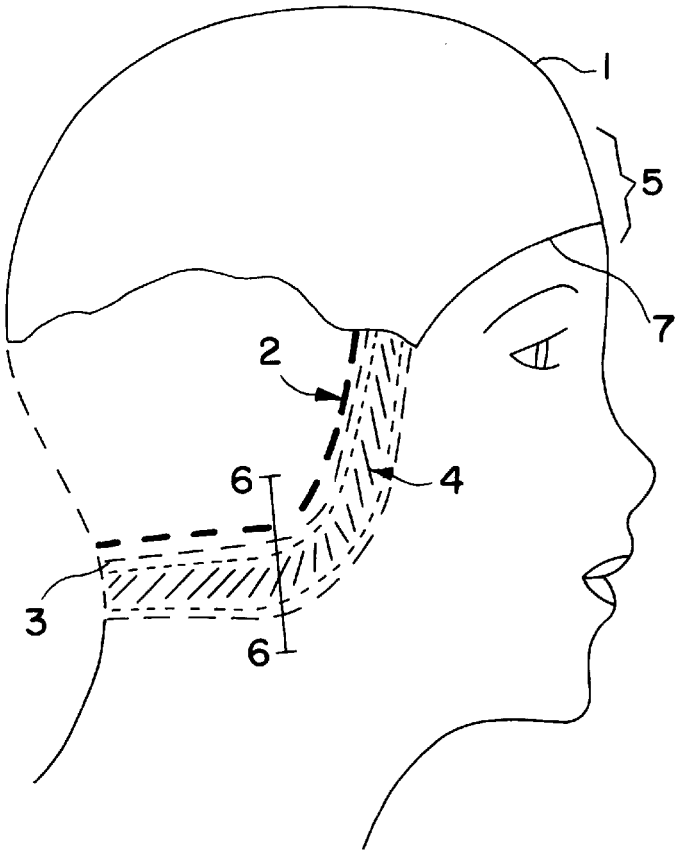
FIG. 1 is a side view of the cap showing the cap positioned on the wearer's head, with a partially exposed view of the internal structure of the cap's margin (which internal structure is depicted by the segmented lines and shaded area).
Figure 2:
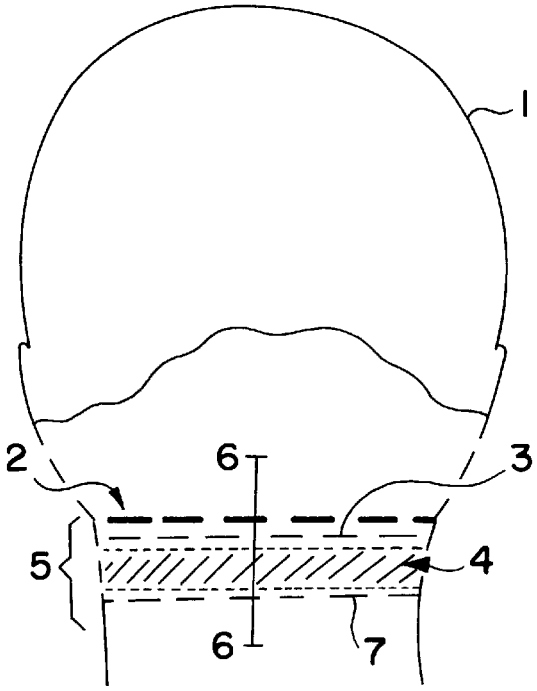
FIG. 2 is a rear view of the cap showing the cap positioned on the wearer's head, with a partially exposed view of the internal structure of the cap's margin (which internal structure is depicted by the segmented lines and shaded area).
Figure 4:
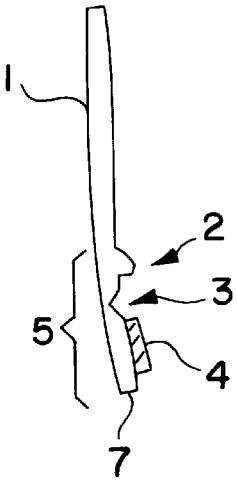
FIG. 4 is a cross sectional view taken generally along line 6—6 in FIGS. 1 and 2 showing the internal structure of the cap including the foldable crease (or fold-line) 3 which is NOT folded upward, the adhesive strip 4 (shaded area) and the border 2, which internal structure is located inside the margin of the cap.

The swimming cap shown in FIGS. 1 and 2 is a substantially hemispherical hollow cap 1 made of a waterproof, lightweight material such as rubber, and having a lower edge 7. The cap 1 covers the top of the wearer's head (i.e. the portion generally covered by hair) and the wearer's ears. A margin of the cap 5 is positioned inside the cap adjacent to lower edge 7 and contacts the wearer's skin along but below the wearer's hairline and under the wearer's ears. The margin of the cap 5, which margin fits snugly but comfortably, more specifically contacts the wearer's skin along the wearer's forehead and temples, under the wearer's ears and across the back of the wearer's neck.

The sealing structure, located inside the cap along the margin 5, is comprised of an adhesive strip 4, which adhesive strip is depicted in FIGS. 1, 2, 3 and 4 by the shaded area. The adhesive strip 4 is used to temporarily seal the margin of the cap 5 to the wearer's head and neck preventing water or other liquid or substance from entering the cap. In order to make sealing of the cap most effective and more comfortable, the adhesive strip 4 may be shaped to conform to the curvatures of the wearer's head and neck which contact the adhesive strip 4.

Figure 3:
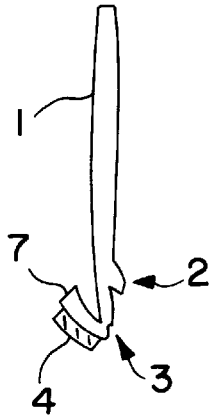
FIG. 3 is a cross sectional view taken generally along line 6—6 in FIGS. 1 and 2 showing the internal structure of the cap including the foldable crease (or fold-line) 3 which is folded upward, the adhesive strip 4 (shaded area) and the border 2, which internal structure is located inside the margin of the cap.

The margin also contains a circumferential, foldable crease (or fold-line) 3 located just behind the adhesive strip 4. The foldable crease (or fold-line) 3 can be folded upward allowing the portion of the cap containing the adhesive strip 4 to be folded upward as shown in FIG. 3. This feature allows the wearer of the cap to properly position the cap on his/her head without the adhesive strip 4 obstructing such positioning. Once the cap is properly positioned on the wearer's head, the foldable crease (or fold-line) 3 can be folded downward to temporarily seal the cap to the wearer's head. If the adhesive strip 4 is covered by plastic or some other covering, such plastic or other covering should be removed after the cap is properly positioned on the wearer's head but before the foldable crease (or fold-line) 3 is folded down to temporarily seal the cap.

The margin also contains a circumferential raised border 2 located immediately behind the afore-mentioned foldable crease (or fold-line) 3, which border is made of the same material as the shell of the cap 1. The fit of the cap is such that the wearer's hair is tucked behind the border 2. This feature makes it less likely that the wearer's hair will contact the adhesive strip 4. The locations of the border 2 and the foldable crease (or fold-line) 3 are interchangeable.

While the preferred embodiment and suggested alternative embodiments of the present invention are described above, it is contemplated that still other modifications/changes/variations may be made thereto without departing from the spirit and scope of the present invention. Such modifications/changes/variations include, without limitation, larger cap and margin circumferences to accommodate different size heads and different lengths, textures and types of hair. It is intended that all such modifications/changes/variations are covered by this application.

I claim:

1. A watertight cap comprising a cap body, said cap body defined by a lower edge, and a margin positioned inside said cap body and adjacent to said lower edge, said margin comprising an adhesive strip adjacent to and extending continuously along said edge, and a raised border adjacent to and extending continuously along said adhesive strip.

2. The watertight cap of claim 1 wherein said margin includes a foldable crease adjacent to and extending continuously along said raised border.

3. The watertight cap of claim 1 wherein said cap body is made of a waterproof and lightweight material selected from the group consisting of latex, rubber, and silicon.

4. The watertight cap of claim 1 wherein said border is made of the same material as said cap body.

* * * * *